US007222565B1

(12) United States Patent
Kasel

(10) Patent No.: US 7,222,565 B1
(45) Date of Patent: May 29, 2007

(54) TWIST NECK

(75) Inventor: Calvin E. Kasel, Wauconda, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/163,994

(22) Filed: Nov. 7, 2005

(51) Int. Cl.
*B65B 13/04* (2006.01)
*B65H 23/32* (2006.01)

(52) U.S. Cl. ..... 100/26; 57/31; 242/615.3; 53/589

(58) Field of Classification Search ..... 100/7, 100/8, 25, 26, 29, 31, 33 PB; 53/589; 57/31, 57/260; 226/196.1; 242/615.3
See application file for complete search history.

(56) References Cited

U.S. PATENT DOCUMENTS 5,078,057 A * 1/1992 Pearson ..... 100/25
5,373,686 A * 12/1994 Lang et al. ..... 53/589
2005/0139092 A1* 6/2005 Schuttler et al. ..... 100/26

FOREIGN PATENT DOCUMENTS

DE 3909223 C2 * 10/1990
DE 4230730 A1 * 3/1994

* cited by examiner

*Primary Examiner*—Jimmy Nguyen
(74) *Attorney, Agent, or Firm*—Mark W. Croll; Donald J. Breh; Levenfeld Pearlstein, LLC

(57) ABSTRACT

A device and method for changing the orientation of an object. One such device includes a twist neck that is used in strapping machines. The twist neck includes an ingress portion, which includes an ingress opening formed therein, and a middle portion. The middle portion includes a pathway formed therein. The pathway has a cross-sectional shape that is substantially similar to the cross-sectional shape of a strap that is used in the strapping machine. A strap is urged into the ingress opening in a first orientation and into the pathway, which itself is in a second orientation. When the strap exits the egress opening, it will be in the second orientation. A user can manipulate the orientation of the associated strap by changing the orientation of the pathway.

13 Claims, 3 Drawing Sheets

TWIST NECK

BACKGROUND OF THE INVENTION

The present invention is directed to a twist neck that allows a material to enter the twist neck in a first orientation and exit the twist neck in a second orientation. In particular, the twist neck may be used to change the orientation of strapping material as it enters and leaves the twist neck.

There are several operations in which a material exits a first body, such as a machine, in a first orientation and then must enter a second body in a second orientation. The second body may be another machine or another component within the same machine. If the material is very stiff, it may not be possible for the material to change orientations. If the material is overly pliable, it may get tangled while exiting the first body in the first orientation and entering the second body in the second orientation. For example, this problem presents itself in strapping machines.

Strapping machines are in widespread use for securing straps around loads. There are numerous types of strapping machines, including hand held and table top models. Table top models typically include a strapping head and drive mechanism, which may be mounted to a frame. A chute, which encircles the load, may also be mounted to the frame.

The drive mechanism 'pulls' or feeds strap material from a source (e.g., a dispenser) into the strapping machine. The drive mechanism urges or feeds the strap through the strapping head, into and around the chute, until the strap material returns to the strapping head. The drive mechanism also retracts the strap material to tension the strap around the load.

During the retraction or tensioning step of the strapping cycle, the strap material must be released from the chute. A typical chute includes inner and outer walls that define a path around which the strap is fed. The inner wall (the wall closest to the load), is generally movable so that, as the strap is 'pulled' or tightened, the inner wall moves out of the way (from between the strap and the load), and the strap thus tensions around the load. In some configurations, the inner and outer walls are formed from a plurality of wall sections.

In certain configurations, the strap material exits the dispenser in a first orientation, travels a path and then must enter the strapping head in a second orientation. As a result, the strap material oftentimes becomes tangled or doesn't run smoothly from the dispenser to the strapping head.

Accordingly, there remains a need for a device and/or method for allowing a material to leave a first body in a first orientation and enter a second body in a second orientation without undue problems. There also remains a need for a strapping machine in which a strapping material may leave, for example, a dispenser in a first orientation, and enter, for example, the strapping head in a second orientation without being tangled.

BRIEF SUMMARY OF THE INVENTION

The present invention is directed to a twist neck that allows a material to enter the twist neck in a first orientation and leave the twist neck in a second orientation. One embodiment of the invention pertains to a twist neck that is used in strapping machines. The twist neck includes an ingress portion, which includes an ingress opening in communication with a pathway formed within a middle portion. The pathway defines a cross-sectional shape that is substantially similar to the cross-sectional shape of a strap that is used in the strapping machine.

A strap can be urged into the ingress opening in a first orientation and into the pathway, which itself is in a second orientation. When the strap exits the pathway, it will be in the second orientation. In this manner, a user may manipulate and/or change the orientation of the associated strap by changing the orientation of the pathway. The ingress and middle portions may be integral or twistably connected. If they are integral, a user may change the orientation of the strap by twisting the entire twist neck; on the other hand, if they are twistably connected, the user may change the orientation of the middle portion with respect to the ingress portion to change the orientation of the strap.

Tubes may also be coupled to the twist necks and, in a preferred embodiment, the twist necks may include coupling portions to receive the tubes. The coupling portions may be integral with or removably connected to the twist neck.

Another embodiment of the invention includes a strapping machine. In one variation of the strapping machine, a strapping head is coupled to a first twist neck and a dispenser is coupled to a second twist neck. The first and second twist necks are coupled to a first tube. The dispenser, first and second twist necks, the first tube, and the strapping head are supported by a support structure. In one embodiment, the support structure includes a frame and a support bench.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
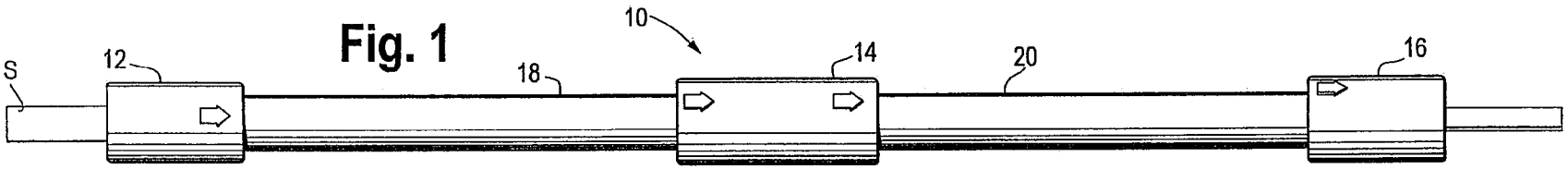
FIG. 1 is a tube configuration pursuant to aspects of the invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

The present invention pertains to a device and method for changing the orientation of material as it enters and exits the device. One embodiment of the invention pertains to a twist neck that is used in strapping machines. The twist neck includes an ingress portion, which includes an ingress opening formed therein, a middle portion and an egress opening. The middle portion includes a pathway formed therein. The pathway preferably has a length and a cross-sectional shape that is substantially similar to the cross-sectional shape of a strap that is used in the strapping machine. The egress opening is positioned at a distal end of the pathway.

In one embodiment, a strap is urged into the ingress opening in a first orientation and into the pathway, which itself is in a second orientation. When the strap exits the egress opening, it will be in the second orientation. In this manner, a user may manipulate and/or change the orientation of the associated strap by changing the orientation of the pathway.

Figure 2:
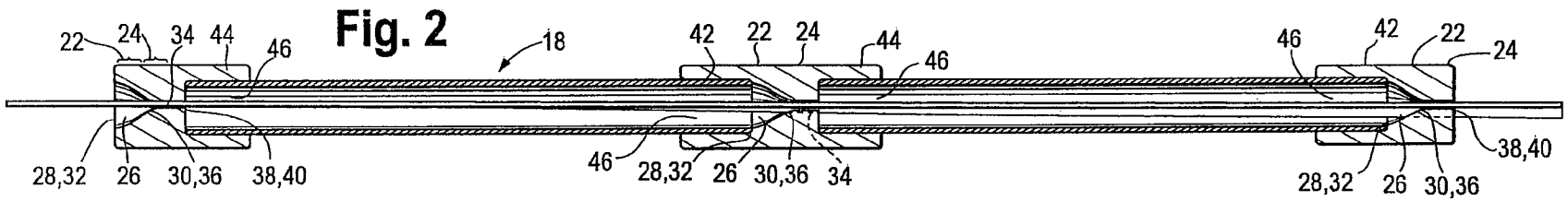
FIG. 2 is a cross-sectional view of FIG. 1.
Figure 3:
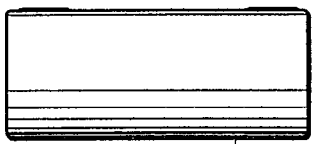
FIG. 3 is a side view of a twist neck pursuant to aspects of the invention.

FIGS. 1 and 2 show a twist tube configuration 10 that incorporates three different embodiments of a twist neck 12, 14, 16 working in conjunction with first and second tubes 18, 20.

FIGS. 3-6 show one embodiment of a twist neck that includes an ingress portion 22 and a middle portion 24. The ingress portion 22 has a tapering portion 26 formed therein, and the tapering portion has near and far ends 28, 30. The near end 28 is an ingress opening 32. The middle portion 24 includes a pathway 34 that has proximal and distal ends 36, 38. The proximal end 36 of the pathway 34 being located at the far end 30 of the tapering portion 26. The distal end 38 of the pathway 34 forms an egress opening 40.

In other embodiments, the twist neck 12, 14, 16 may further include proximal and distal coupling portions 42, 44 that are used to couple the twist necks to another object, such as a tube 18, 20. For example in FIGS. 1 and 2, the second neck 14 includes both proximal and distal coupling portions 42, 44, the first neck 12 includes only a distal coupling portion 44, and the third neck 16 includes only a proximal coupling portion 42. Other twist necks not shown need not have any coupling portions.

In FIGS. 1-2, the coupling portions 42, 44 include a hollow 46 formed therein that is configured to receive the first or second tube 18, 20. In either embodiment, the hollow 46 should have a sufficient cross sectional area to receive the associated strap S and, in preferred embodiments, the hollow has about the same cross sectional area as the ingress opening 32. Note that twist necks lacking coupling portions may still be coupled to tubes by other methods and structures.

Figure 7:
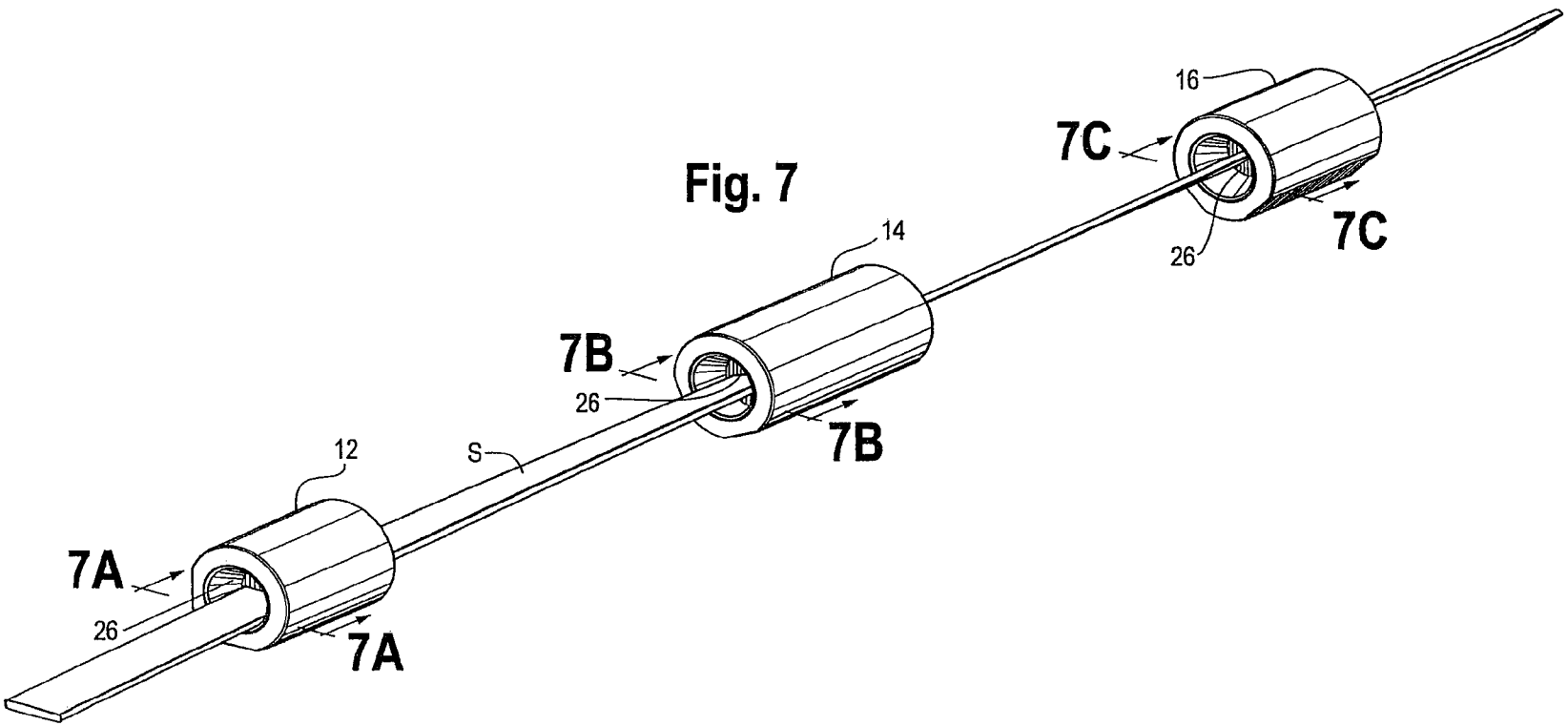
FIG. 7 is an isometric view of three twist necks pursuant to embodiments of the invention working in conjunction with one another to change the orientation of an associated strap.

FIG. 7 shows a plurality of twist necks 12, 14, 16 cooperating with one another, without tubes, to change the orientation of an associated strap S, which may be used, for example, in a strapping machine 48 to strap loads L together. Those of skill in the art will recognize that only one, two, four or more twist necks 12, 14, 16 may be used to change the orientation of the associates strap S, as well as the twist tube configuration 10 shown in FIGS. 1-2.

Figure 8:
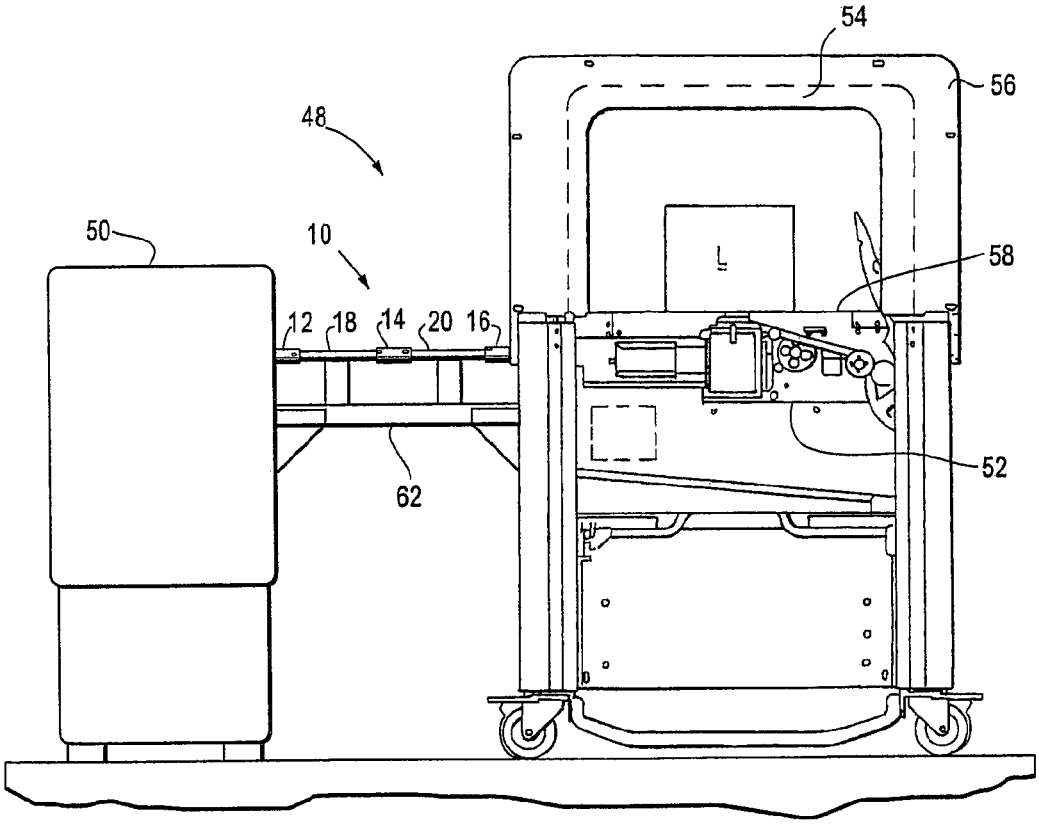
FIG. 8 is a front view of a strapping machine pursuant to aspects of the invention.

As shown in FIG. 8, the orientation of the associated strap S may need to change during the strapping operation. The orientation of the strap S often changes when the strap is being fed from the supply source 50 to the strapping head 52 of the strapping machine 48. There are other locations where the orientation of the strap S may also need to change, such as, for example, when the strap is being fed from the strapping head 52 into the chute 54, which may be coupled to a frame 56 of the strapping machine 48. There may be a support structure 62 to support the either one, two, three or more twist necks 12, 14, 16 working with one another or the twist tube configuration 10. The support structure 62 may comprise a desk top 58 that also supports the strapping head 52, the frame 56, which supports the chute 54, or any other type of support structure.

Figure 7C:
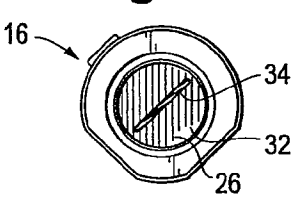
FIG. 7C is a front view of a third twist neck shown in FIG. 7.
Figure 7B:
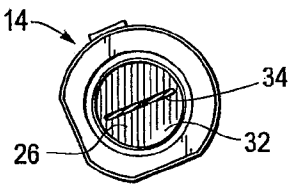
FIG. 7B is a front view of a second twist neck shown in FIG. 7.
Figure 7A:
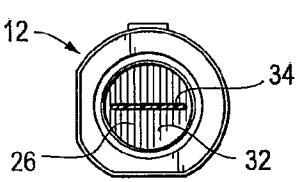
FIG. 7A is a front view of a first twist neck shown in FIG. 7.

As shown in FIGS. 7 and 7A, the associated strap S enters the ingress opening 32 of the first twist neck 12 in a first orientation. The associated strap S then is gradually urged through the tapering portion 26 and into the pathway 34, as shown in FIGS. 3-6. If the pathway 34 is in the same orientation as the associated strap S was prior to entering the pathway, as is shown in FIGS. 7 and 7A, the orientation of the associated strap does not change.

Figure 4:
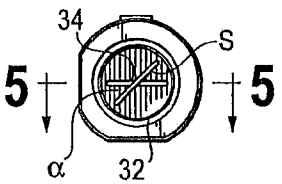
FIG. 4 is a front view of FIG. 3.
Figure 5:
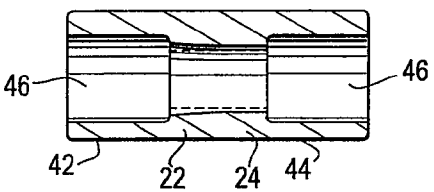
FIG. 5 is a cross-sectional view of FIG. 3.
Figure 6:
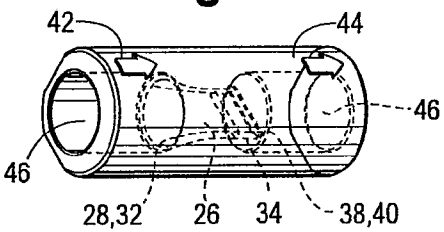
FIG. 6 is an isometric view of FIG. 3 with hidden lines showing the internal structure of the twist neck.

As shown in FIGS. 7 and 7B, the associated strap S enters the ingress opening 32 of the second neck 14 and is gradually biased into a second orientation as it is urged into the second tapering portion 26 and eventually into the second pathway 34, which is in the second orientation. The tapering portion 26 may define any shape. The tapering portion 26 includes at its near end 28 the ingress opening 32, which defines any cross-sectional shape and, in the preferred embodiments shown, defines a circular shape. The ingress opening 32 preferably has a larger cross sectional area than the cross sectional area of any portion of the pathway 34. In this manner, the ingress opening 32 may receive the associated strap S in a variety of orientations. As shown in FIG. 4, the twist neck 12, 14, 16 is configured so that the angle a between the orientation the associated strap S is received in and enters the twist neck and the orientation the associated strap exits the twist neck is as large as thirty degrees. In other embodiments not shown, the angle may be greater than thirty degrees.

The associated strap S is then gradually biased into the orientation of the pathway 34 as it is urged through the tapering portion 26 and into the pathway. In a preferred embodiment, the pathway 34 has a length and a substantially uniform cross-sectional area that defines a strap shape. The strap shape is substantially similar to a cross sectional shape of the associated strap S. Thus, the cross sectional shape of the pathway preferably provides only about enough space for the associated strap S to enter the pathway 34 in one orientation, which is the orientation of the pathway. As a result, the associated strap S will exit the egress opening 40 at the distal end 38 of the pathway 34 in a second orientation, which is the same orientation of the pathway 34 of the second twist neck 14.

If desired, as shown in FIGS. 7 and 7C, the orientation of the associated strap S may be manipulated yet again by a third twist neck 16 by the same process described above. Changing the strap orientations may be repeated as many times as required by a user.

If a user desires to change the orientation of the associated strap S, he/she may turn the twist neck 12, 14, 16, thus changing the orientation of the pathway 34 and the associated strap as it is urged through the twist neck. Note that in the preferred embodiments shown, the coupling portions 42, 44, ingress portion 22, and the middle portion 24 are integral with one another. Thus, the twist neck 12, 14, 16 should have at least one degree of movement to allow the user to turn the entire twist neck.

In other embodiments not shown, the coupling portions 42, 44, ingress portion 22 and middle portion 24 may be removably and twistably connected to one another. For example, the coupling portions 42, 44 may be removably connected to the ingress and middle portions 22, 24. Thus, when the twist neck 12, 14, 16 need not be coupled to an associated structure, such as the tubes 18, 20 described above, the coupling portions may be removed.

In the other embodiments in which the ingress and middle portions 22, 24 are twistably connected to one anther, the middle portion may be turned with respect to the ingress portion without twisting the entire twist neck 12, 14, 16. This allows one to fix the twist neck 12, 14, 16 to a support structure 62 so that the ingress portion 22 has zero degrees of freedom—but still allows a user to twist the middle portion 24 and the pathway 34 formed therein. The user may then change the orientation of the pathway 34 and, thus, the associated strap S as it passes through the pathway—even though the twist neck 12, 14, 16 is fixed in a manner that provides zero degrees of freedom to the ingress portion 22.

In the embodiments shown, the twist neck can be manipulated to change the orientation of the associated strap by thirty degrees. In other embodiments not shown, the twist necks may be manipulated a greater or lesser amount.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular. Further, any object modified by the word "associated" shall be construed so that it is not an element of the claim, but rather an object that is acted upon or used by the elements of the claim.

From the foregoing it will be observed that numerous modifications and variations can be made to the invention without departing from the true spirit and scope of the novel concepts of the present invention. It is to be understood that no limitation with respect to the specific embodiments illustrated is intended or to be inferred. The disclosure is intended to cover all such modifications as fall within the scope of the invention.

What is claimed is:

1. A twist neck for use with a strapping machine, the twist neck comprising:

an ingress portion having a hollow ingress opening and a tapering portion;

a middle portion having a pathway formed therein that is in communication with the ingress opening, the pathway defining a strap shape substantially similar to a cross-sectional shape of an associated strap that is used in the strapping machine;

a first coupling portion is connected to the ingress portion and forming a hollow therein for receiving a tube; and an egress opening at a distal end of the pathway, a second coupling portion is connected to the middle portion and forming a hollow therein, wherein a cross-sectional area of the ingress opening is larger than a cross-sectional area of the pathway, and wherein the ingress opening, pathway and egress opening are configured to allow the associated strap to enter into the twist neck in a first orientation and exit out of the twist neck in a second orientation that is based on an orientation of the pathway so that a user can manipulate the second orientation by changing the orientation of the pathway formed within the middle portion wherein an angle between an orientation of the associated strap enters into the twist neck in a first orientation and an orientation of the associated strap exits out of the twist neck in a second orientation is as large as thirty degrees.

2. The twist neck of claim 1, wherein the a tapering portion having near and far ends, the ingress opening being positioned at the near end and the far end being located at a proximal end of the pathway.

3. A twist neck arrangement for use with a strapping machine, the twist neck configuration comprising:

a first twist neck, the first twist neck including a first hollow ingress opening, a first tapering portion, and a first neck pathway formed therein, the first pathway defining a strap shape substantially similar to a cross-sectional shape of an associated strap that is used in the strapping machine, and the first ingress opening being larger than the first pathway;

a first tube coupled to the first twist neck; and, a second twist neck coupled to the first tube, the second twist neck including a second hollow ingress opening, a second tapering portion, and a second neck pathway formed therein, the second pathway defining a strap shape substantially similar to a cross-sectional shape of the associated strap that is used in the strapping machine, and the second ingress opening being larger than the second pathway, wherein the twist neck arrangement is configured so that an associated strap exits the first neck pathway in a first orientation that is based on a first neck orientation, extends through the first tube and the second neck pathway, and exits the second neck pathway in a second orientation that is based on a second neck orientation wherein an angle between an orientation of the associated strap enters into the second twist neck and an orientation of the associated strap exits the second twist neck is as large as thirty degrees.

4. The twist tube configuration of claim 3, wherein the first twist neck further comprises a first distal coupling portion defining a first hollow therein and configured to receive the first tube, and wherein the second twist neck further comprises a second proximal coupling portion defining a second hollow therein and configured to receive the first tube.

5. The twist tube configuration of claim 3, further comprising a second tube coupled to the second twist neck and a third twist neck coupled to the second tube.

6. The twist tube configuration of claim 5, wherein the third twist neck further comprises a third ingress opening and a third neck pathway formed therein, the third pathway defining a strap shape substantially similar to a cross-sectional shape of the associated strap that is used in the strapping machine, and the third ingress opening being larger than the third pathway.

7. The twist tube configuration of claim 6, wherein the third twist neck is configured so that an associated strap can enter the third neck pathway in the second orientation and exit the third neck pathway in a third orientation, the third orientation being based on an orientation of the third neck pathway.

8. A strapping machine comprising:

a support structure;

a strapping head connected to the support structure;

a chute connected to the support structure;

a first twist neck coupled to the strapping head of the support structure, wherein the first twist neck includes a hollow first ingress portion having a first ingress opening, and a first tapering portion, a first middle portion having a first pathway formed therein that is in communication with the first ingress opening, a coupling portion is connected to the first ingress portion and forming a hollow therein for receiving a first tube, the first pathway defining a strap shape substantially similar to a cross-sectional shape of an associated strap that is used in the strapping machine, and the first twist neck including an egress opening at a first distal end of the pathway, wherein a cross-sectional area of the first ingress opening is larger than a cross-sectional area of the first pathway, and wherein the first ingress opening, first pathway and first egress opening are configured to allow the associated strap of the strapping machine to enter into the first twist neck in a first orientation and exit out of the first twist neck in a second orientation that is based on an orientation of the first pathway so that a user can manipulate the second orientation by changing the orientation of the first pathway formed within the middle portion wherein an angle between an orientation of the associated strap enters into the first twist neck and an orientation of the associated strap exits the first twist neck is as large as thirty degrees.

9. The strapping machine of claim 8, wherein the first tapering portion having first near and far ends, the first ingress opening being positioned at the near end and the far end being located at a proximal end of the first pathway.

10. The strapping machine of claim 8, wherein the hollow first ingress portion is integral with the first middle portion and the first twist neck is coupled to the strapping head or the support structure so that the first twist neck has one degree of freedom, and wherein the user can manipulate the second orientation by twisting the entire first twist neck.

11. The strapping machine of claim 8, further comprising a dispenser connected to the support structure, wherein the support structure farther comprises a frame and a desk top.

12. The strapping machine of claim 11, further comprising a second twist neck coupled to the dispenser, wherein the first twist neck is coupled to the strapping head.

13. The strapping machine of claim 12, a first tube coupled to the first and second twist necks.

* * * * *

UNITED STATES PATENT AND TRADEMARK OFFICE

CERTIFICATE OF CORRECTION

PATENT NO. : 7,222,565 B1
APPLICATION NO. : 11/163994
DATED : May 29, 2007
INVENTOR(S) : Kasel It is certified that error appears in the above-identified patent and that said Letters Patent is hereby corrected as shown below:

Col. 6, claim 2, line 1 shoud read:

--The twist neck of claim 1, wherein the tapering--

Col. 6, claim 8, line 5 should read:

--a first twist neck coupled to the strapping head or the--

Col. 6, claim 8, line 8 should read:

--opening and a first tapering portion, a first middle--

Col. 8, claim 11, line 3 should read:

--support structure further comprises a frame and a desk top.--

Col. 8, claim 13, line 1 should read:

--The strapping machine of claim 12, wherein the first tube--

Signed and Sealed this

Tenth Day of July, 2007

JON W. DUDAS
*Director of the United States Patent and Trademark Office*